US010066593B2

(12) United States Patent
Marrs et al.

(10) Patent No.: US 10,066,593 B2
(45) Date of Patent: Sep. 4, 2018

(54) ELECTRONIC SPARK TIMING CONTROL SYSTEM FOR AN AC IGNITION SYSTEM

(71) Applicant: MARSHALL ELECTRIC CORP., Rochester, IN (US)

(72) Inventors: Thomas C. Marrs, Rochester, IN (US); Stephen P. Barlow, Carmel, IN (US)

(73) Assignee: MARSHALL ELECTRIC CORP., Rochester, IN (US)

( * ) Notice: Subject to any disclaimer, the term of this patent is extended or adjusted under 35 U.S.C. 154(b) by 0 days.

(21) Appl. No.: 15/796,249

(22) Filed: Oct. 27, 2017

(65) Prior Publication Data

US 2018/0216597 A1 Aug. 2, 2018

Related U.S. Application Data

(63) Continuation-in-part of application No. 15/419,403, filed on Jan. 30, 2017.

(51) Int. Cl.
*F02P 9/00* (2006.01)
*F02P 3/08* (2006.01)

(52) U.S. Cl.
CPC ..... *F02P 9/002* (2013.01); *F02P 3/0876* (2013.01)

(58) Field of Classification Search
CPC ..... F02P 3/0876
See application file for complete search history.

(56) References Cited

U.S. PATENT DOCUMENTS 4,446,842 A * 5/1984 Iwasaki ..... F02P 3/01 123/169 PA
4,977,883 A * 12/1990 Koiwa ..... F02P 3/051 123/609
4,996,967 A * 3/1991 Rosswurm ..... F02P 9/007 123/598
4,998,526 A * 3/1991 Gokhale ..... F02P 3/005 123/598
5,020,506 A * 6/1991 Ozawa ..... F02P 1/086 123/631
5,056,496 A * 10/1991 Morino ..... F02P 3/0884 123/604
5,060,623 A * 10/1991 McCoy ..... F02P 3/0884 123/605
5,806,504 A 9/1998 French et al.
6,112,730 A * 9/2000 Marrs ..... F02P 23/04 123/606
6,135,099 A * 10/2000 Marrs ..... F02P 3/0884 123/606
61,354,099 10/2000 Marrs (Continued)

*Primary Examiner* — Hieu T Vo
*Assistant Examiner* — Sherman Manley
(74) *Attorney, Agent, or Firm* — Egbert Law Offices, PLLC

(57) ABSTRACT

A method of firing at least one spark plug of an internal combustion engine include supplying AC power to the spark plug in which the AC power has a waveform with a rising edge and a falling edge, activating the spark plug during the rising edge of the waveform, and deactivating the spark plug during the falling edge of the waveform. This method further includes connecting an engine control module and a vehicle power supply to at least one AC ignition coil and connecting the AC ignition coil to the spark plug or spark plugs. The firing duration of the AC ignition coil or transformer mirrors a digital square waveform duration from the engine control module.

19 Claims, 3 Drawing Sheets

(56) References Cited

U.S. PATENT DOCUMENTS

| | | | | |
|---|---|---|---|---|
| 6,670,777 | B1 * | 12/2003 | Petruska | F02P 3/0876 123/598 |
| 8,931,457 | B2 * | 1/2015 | Petruska | F02P 15/02 123/406.12 |
| 9,709,017 | B2 * | 7/2017 | Hashimoto | F02P 9/007 |
| 9,771,918 | B2 * | 9/2017 | Nakayama | F02P 9/002 |
| 9,784,232 | B1 * | 10/2017 | Marrs | F02P 9/002 |
| 2016/0047352 | A1 * | 2/2016 | Nakayama | F02P 3/0453 123/406.19 |

* cited by examiner

ELECTRONIC SPARK TIMING CONTROL SYSTEM FOR AN AC IGNITION SYSTEM

CROSS-REFERENCE TO RELATED APPLICATIONS

The present application claims priority from U.S. patent application Ser. No. 15/419,403, filed on Jan. 30, 2017, and entitled "Electronic Spark Timing Control System for an AC Ignition System", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to ignition systems for internal combustion engines. More particularly, the present invention relates to electrical AC ignition systems that are used for the igniting of fuel within the internal combustion chambers of the internal combustion engines. More particularly, the present invention relates to electronic spark timing control of an AC ignition coil which supplies applies an AC voltage for the ignition of the spark plug(s) within the internal combustion engine.

2. Description of Related Art Including Information Disclosed Under 37 CFR 1.97 and 37 CFR 1.98

Most internal combustion engines have some type of an ignition circuit to generate a spark in the cylinder. The spark causes combustion of the fuel in the cylinder to drive the piston and the attached crankshaft. Typically, the engine includes a plurality of permanent magnets mounted on the flywheel of the engine and a charge coil mounted on the engine housing in the vicinity of the flywheel. As the flywheel rotates, the magnets pass the charge coil. A voltage is thereby generated on the charge coil and this voltage is used to charge a high-voltage capacitor. The high-voltage charge on the capacitor is released to the ignition coil by way of a triggering circuit so as to cause a high-voltage, short-duration electrical spark across the gap of the spark plug(s) and ignite the fuel in the cylinder. This type of ignition is called a capacitive discharge ignition.

Typically, the engine control module provides an electronic spark timing pulse which is used to command a given spark event for a given engine cylinder. This electronic spark timing pulse is commanded for a given amount of time to charge the primary coil to the desired current or energy. The electronic spark timing pulse duration is often referred to as "dwell-time" or charging time for a given coil and engine operating condition. For example, during cold starting conditions, when the engine is cold and the battery voltage is low, the electronic spark timing control signal for a given cylinder may have an extended pulse duration to fully charge the coil to generate the necessary energy in the primary coil. The energy is then transferred to the secondary coil that is connected to the spark plug output. Similarly, during hot engine conditions and nominal battery voltage, the electronic spark timing pulse can be commanded to have a shorter duration to fully charge the primary coil to a given energy level. As a result, a given electronic spark timing pulse for commanding a given DC coil operation will vary the dwell time or charging time depending on several engine sensor inputs and desired engine operating conditions.

Current DC ignition systems use the electronic spark timing pulse to command a semiconductor power switch device which is connected to the primary coil and allows the coil to reach a targeted primary current or energy. When the semiconductor power device is switched off, the stored energy in the primary coil is then transferred to the secondary coil and available voltage of approximately 40,000 volts can be provided to the spark plug output based on the clamping voltage of the power semiconductor switch and the turns ratio of the secondary-to-primary windings.

Therefore, the high-voltage spark is commanded by the falling edge of an electronic spark timing pulse. This translates to a command "turn-off" of the semiconductor power device. Energy is then transferred to the spark plug with an exponential voltage decay. Typically, one spark event occurs for each electronic spark timing cycle for a given engine cylinder. This method of control has been employed by numerous engine control module designs using command DC ignition systems for many years and has become the general method of firing a given spark plug used in internal combustion engines.

The design of standard reciprocating internal combustion engines which use spark plugs and DC induction coils to initiate combustion have, for years, utilized combustion chamber shapes and spark plug placements which are heavily influenced by the need to reliably initiate combustion using a single short-duration spark of relatively low energy intensity that is timed to fire off the falling edge of the given electronic spark timing pulse.

In recent years, however, increased emphasis has been placed on fuel efficiency, completeness of combustion, exhaust cleanliness, and reduced variability in cycle-to-cycle combustion. This emphasis has meant that the shape of the combustion chamber must be modified and the ratio of the air-fuel mixture changed. In some cases, a procedure has been used which deliberately introduces strong turbulence or rotary flow to the air-fuel mixture at the area where the spark plug electrodes are placed. This often causes an interruption or blowing out of the arc. This places increasing demands on the effectiveness of the combustion ignition initiation process.

In the past, various patents have issued with respect to such ignition systems. For example, U.S. Pat. No. 5,806,504, issued on Sep. 15, 1998 to French et al., teaches an ignition circuit for an internal combustion engine in which the ignition circuit includes a transformer having a secondary winding for generating a spark and having first and second primary windings. A capacitor is connected to the first primary winding to provide a high-energy capacitive discharge voltage to the transformer. A voltage regulator is connected to the secondary primary winding for generating an alternating current voltage. A control circuit is connected to the capacitor and to the voltage generator for providing control signals to discharge the high-energy capacitive discharge voltage to the first primary winding and for providing control signals to the voltage generator so as to generate an alternating current and voltage.

U.S. Pat. No. 4,998,526, issued on Mar. 12, 1991 to K. P. Gokhae, teaches an alternating current ignition system. The system applies alternating current to the electrodes of a spark plug to maintain an arc at the electrodes for a desired period of time. The amplitude of the arc current can be varied. The alternating current is developed by a DC-to-AC inverter that includes a transformer that has a center-primary and a secondary that is connected to the spark plug. An arc is initiated at the spark plug by discharging a capacitor to one of the winding portions at the center-primary. Alternatively, the energy stored in an inductor may be supplied to a primary winding portion to initiate an arc. The ignition system is powered by a controlled current source that receives input power from a source of direct voltage, such as a battery on the motor vehicle.

In each of these prior art patents, the devices used dual mechanisms in which high-energy discharges were supplemented with a low-energy extending mechanism. The method of extending the arc, however, presents problems to the end-user. First, the mechanism is, by nature, electronically complex in that multiple control mechanisms must be present either in the form of two separate arc mechanisms. Secondly, no method is presented for automatically sustaining the arc under a condition of repeated interruptions. Additionally, these mechanisms do not necessarily provide for a single functional-block unit of low mass and small size which contains all of the necessary functions within.

U.S. Pat. No. 6,135,099, issued on Oct. 24, 2000 to T. Marrs, discloses an ignition system for an internal combustion engine that comprises a transformer means having a primary winding adapted to be connected to a power supply and having a secondary winding adapted be connected to a spark plug. The transformer serves to produce an output from the secondary winding having a frequency of between 1 kHz and 100 kHz and a voltage of at least 20 kV. A controller is connected to the transformer so as to activate and deactivate the output of the transformer means relative to the combustion cycle. The transformer serves to produce the output having an alternating current with a high-voltage sine wave reaching at least 20 kV. A voltage regulator is connected to the power supply into the transformer so as to provide a constant DC voltage input to the transformer. The transformer produces power of constant wattage from the output of the secondary winding during the activation by the controller. The controller is connected to the transformer so as to allow the transformer to produce an arc of controllable duration across the electrode of the spark plug. This duration can be between 0.25 milliseconds and 4 milliseconds. A battery is connected the primary winding of the transformer. The battery produces a variable voltage of between five and fifteen volts.

It is object of the present invention to provide an electronic spark timing control system that produces a spark arc of a controllable duration.

It is another object of the present invention to provide an electronic spark timing control system that allows various spark arc patterns across the electrode of the spark plug(s).

It is another object of the present invention to provide electronic spark timing control system that promotes fuel efficiency.

It is another object of the present invention provide electronic spark timing control system which provides complete combustion and exhaust cleanliness.

It is another object of the present invention to provide electronic spark timing control system that reduces variability in cycle-to-cycle combustion.

It is another object of the present invention to provide an electronic spark timing control system that provides the ability to pulse the spark arc.

It is still another object of the present invention to provide electronic spark timing control system that allows for a very small AC ignition coil to be used.

These and other objects and advantages of the present invention will become apparent from a reading of the attached specification and appended claims.

BRIEF SUMMARY OF THE INVENTION

The present invention is a spark AC ignition system that comprises a vehicle battery power source, a spark plug(s), an AC ignition coil connected to the spark plug(s) so as to apply an AC voltage to the spark plug(s), and an engine control module connected to the AC ignition coil so as to provide an electronic spark timing pulse to the AC ignition coil. The vehicle battery is used to supply power to the engine control module and to an AC ignition coil(s) or a transformer(s). The electronic spark timing control signal voltage has a waveform with a rising edge and a falling edge. The engine control module transmits the electronic spark timing control signal to the AC ignition system so as to activate the spark plug(s) to activate the arc of the spark plug(s) between the rising edge and the falling edge of the electronic spark timing control waveform. In the spark AC ignition system of the present invention, a power supply or battery is connected to the engine control module. The battery produces at least six volts typically. A boost voltage regulator or circuit is connected to the battery and the input to the AC ignition coil(s) or transformer(s). The boost regulator output capacitor stores energy used to spark the spark plug(s). A first $N_{channel}$ field effect transistor and a second $N_{channel}$ field effect transistor are cooperative with the boost voltage regulator output capacitor and connected to the transformer primary windings so as to transmit energy alternately to the spark plug(s).

The electronic spark timing control waveform has a logic high of 5 volts and a logic low of 0 volts, typically. In some applications, this control waveform can have a logic high of 12 volts and a logic low of 0 volts. The rising edge would be from 0 volts to 5 volts in most applications. The falling edge is from 5 volts to 0 volts under these circumstances. The signal is between 25 microseconds and 5 milliseconds (or longer as desired). The AC ignition coil activates the spark plug(s) in accordance with the control signal from the engine control module. A boost voltage regulator circuit is cooperative with the AC ignition coil seal(s) or transformer (s) so as to store energy from the battery while the AC ignition system activates the spark plug(s). This energy can also be stored while the AC ignition system fires the spark plugs.

The system of the present invention can also include an internal combustion engine. The spark plug(s) is cooperative with the internal combustion engine so as to ignite fuel in the cylinder of the internal combustion engine when the spark plug is activated. The AC ignition coil can be mounted directly onto the spark plug.

The present invention is also a method of firing a spark plug(s) of an internal combustion engine. This method includes the steps of: (1) supplying AC power to the spark plug(s) in which the AC power has a waveform with a rising edge and a falling edge; (2) activating the AC power to the spark plug(s) during the rising edge of the control waveform; and (3) deactivating power to the spark plug(s) during the falling edge of the control waveform.

The method of the present invention also includes connecting a battery and an engine control signal to an AC ignition coil and connecting the AC ignition coil to the spark plug(s). The AC power is generated by the battery and the AC ignition coil(s) or transformer(s) to the spark plug(s). The AC ignition system is active between the rising edge and the falling edge of the control waveform from the engine control module. The AC firing duration of the spark plug(s) mirrors the electronic spark timing control waveform duration from the engine control module. A battery is connected to the engine control module as an AC ignition system input, as described herein previously. The battery will have at least six volts. The DC input voltage from the battery is converted to an AC output waveform used to develop a spark arc across a spark plug(s). The energy stored from the battery is used during the steps of activating and deactivating the electronic spark timing control signal. The control waveform is between zero and five volts typically. The step of deactivating is typically between 25 microseconds and 5 milliseconds following the step of deactivating.

The present invention generates a continuous sinusoidal AC high-voltage spark output waveform. The spark event is of a predetermined spark duration based on engine conditions required to provide the adequate energy to ignite the combustion mixture for a given cylinder condition. The present AC ignition system can be commanded to provide a given AC high-voltage spark event of a predetermined duration based upon the AC system design elements. The AC ignition system can be configured to directly control the spark arc pattern to start on the rising edge of the electronic spark timing pulse and commanded off during the falling edge of the electronic spark timing pulse itself. In this way, various electronic spark timing pulse-width commands and/or burst patterns can be employed to control the arc duration of the spark plug(s) directly.

Electronic spark timing control method of the present invention provides for the ability to precisely control the spark timing and spark duration. With this control method, spark arc duration can be composed of a series of short or long pulses, a series of multi-strikes, or a series of multi-bursts, as desired. These types of electronic spark timing pulses with the use of an AC ignition system can be deployed practically instantaneously, without the need for excessive delay due to the dwell/charging times required by standard DC ignition systems used today.

The AC ignition system control method for an internal combustion engine of the present invention can include a vehicle control computer, an engine control module, a power-train control module, a transmission control module, or similar engine control module. The engine control module has one or more electronic spark timing output pulses, each of a duration from 25 microseconds to as much a 5 milliseconds (or longer as desired) for producing timing control signals to the AC ignition system. As such, it can be used to activate the spark output during the rising edge and to deactivate the spark output during the falling edge of the engine control module's electronic spark timing output to the input of an AC ignition system.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
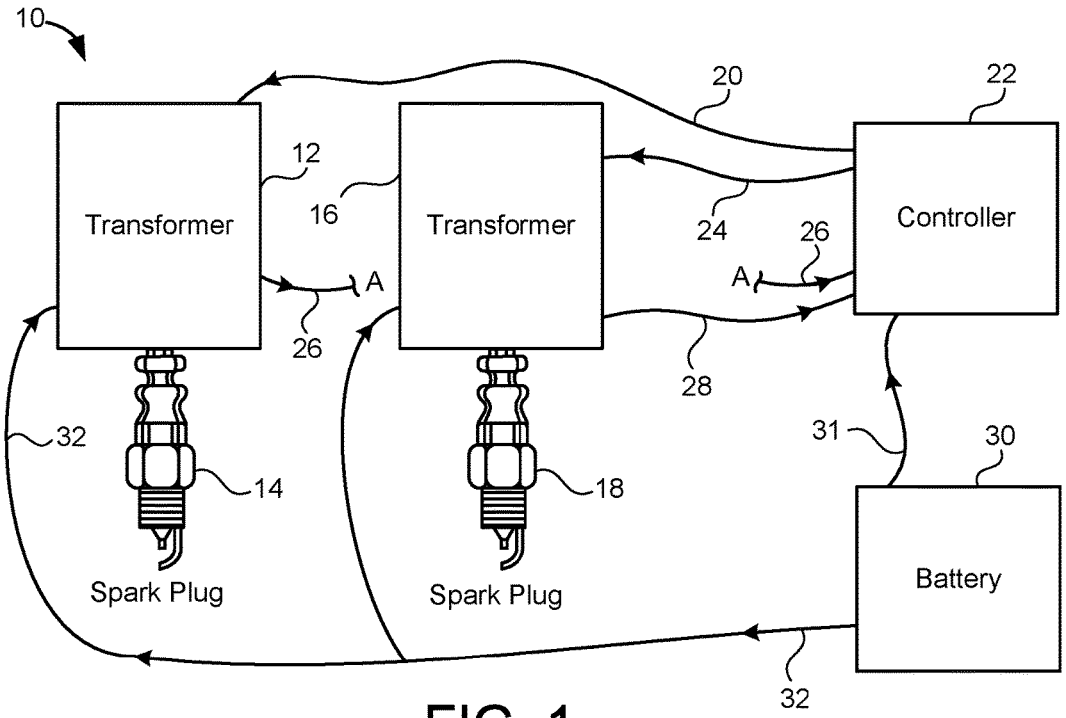
FIG. 1 is a diagrammatic illustration of the electronic spark timing control system of the present invention.

Referring to FIG. 1, there is shown the electronic spark timing control system 10 of the present invention. In particular, in FIG. 1, there is a transformer 12 that is directly connected to a spark plug 14. Similarly, a transformer 16 is directly connected to spark plug 18. An electrical control line 20 will extend from the engine control module 22 to the transformer 12. Another electrical control line 24 will extend from the engine control module 22 to the transformer 16. As such, the engine control module 22 can provide the necessary timing control signals to the transformers 12 and 16 for the firing of the spark plugs 14 and 18, respectively. Each of the transformers 12 and 16 can be an AC ignition coil.

The transformer 12 can include a sensor line 26 extending back to the engine control module 22, if desired. The transformer 16 can also include a sensor line 28 extending back to the engine control module 22, if desired. As such, the engine control module 22 can receive suitable signals from the transformers 12 and 16 as to the operating conditions of the spark plugs 14 and 18 for monitoring of the output current and output voltage of the secondary winding. The electrical control lines 22 and 24 allow the engine control module 22 to be suitably programmed to optimize the firing of the spark plugs 14 and 18 in relation to items such as engine temperature and fuel consumption (along with other variables). An automotive battery 30 is configured so as to supply at least six volts to the engine control module 22. The battery 30 can also supply at least six volts input voltage to the transformers 12 and 16 by lines 32. Lines 32 can be connected to the terminals of the battery 30.

As can be seen in FIG. 1, unlike conventional ignition coils, the firing of each of the transformers 12 and 16 is carried out directly on the respective spark plugs 14 and 18. The engine control module 22 can be a microprocessor which is programmed with the necessary information for the optimization of the firing of each of the spark plugs 14 and 18. The engine control module 22 can receive inputs from the crankshaft or from the engine as to the specific time at which the firing of the combustion chamber associated with each of the spark plugs 14 and 18 is necessary. Since each of the transformers 12 and 16 is located directly on the spark plugs 14 and 18, respectively, and since they operate at low frequencies, radio interference within the vehicle is effectively avoided. Suitable shielding can be applied to each of the transformers 12 and 16 to further guard against any radio frequency interference.

Figure 2:
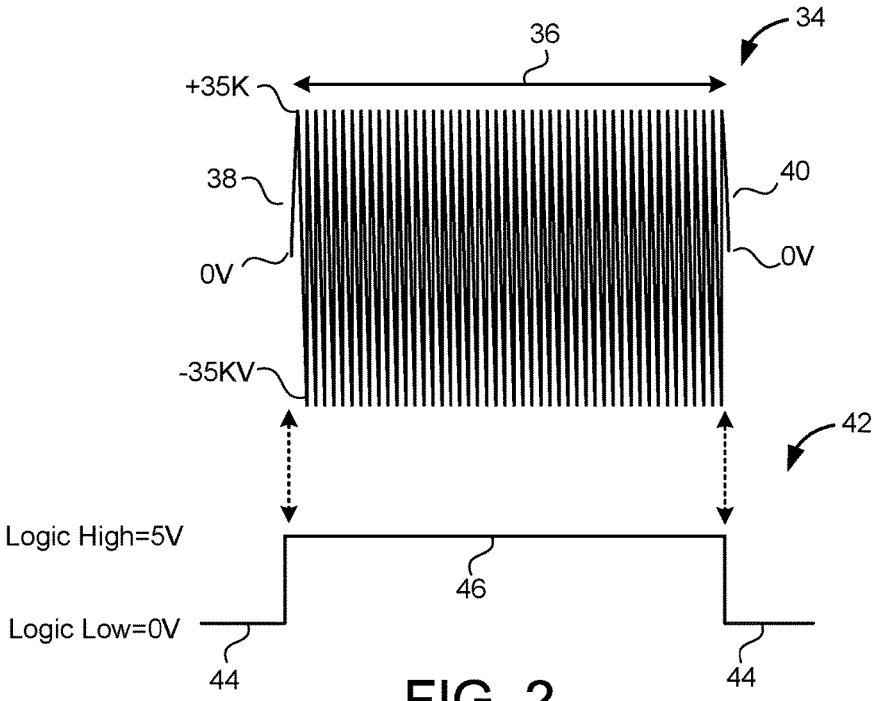
FIG. 2 shows a waveform associated with the firing of the spark plug(s) in relation to commands from the engine control module.

FIG. 2 illustrates an important feature of the present invention. In FIG. 2, there is a waveform 34 which shows the output voltage waveform provided to one of the spark plugs 14 and 18 by way of the respective transformers 12 and 16. This is an AC high-voltage sinusoidal waveform that starts at zero volts and oscillates from +35 KV to −35 KV typically. Arrow 36 illustrates the "on time", or duration, during which the AC high-voltage output waveform 34 is commanded to spark the spark plug(s). The 0 volts goes to 35 KV along the rising edge 38 of the waveform. The high-voltage goes back down to zero volts during the falling edge 40 of the waveform 34. In order to fire one of the spark plugs 14 or 18, the AC high-voltage output waveform is applied continuously between the rising edge 34 and the falling edge 40. During this "on time" 36, the spark plug(s) will be firing continuously within the cylinder of the internal combustion engine. It is important to note that, based on the command "on time" and/or the connection method of the primary windings, the AC high-voltage waveform can complete on a-35 KV to 0V transition or a +35 KV to 0V transition. Likewise, the starting of the AC high-voltage waveform can begin on a transition from 0V to +35 KV or a 0V to −35 KV transition. This continuous firing starts at the rising edge 38 and ends at the falling edge 40. As such, the spark plug(s) is activated during the rising edge 34 and deactivated during the falling edge 40. The duration of the "on time" 36 allows a series of AC high-voltage pulses to be applied during this "on time" to the spark plug(s). By activating at the rising edge and deactivating at the falling edge, the present invention allows an AC ignition system to be deployed instantaneously without the need for excessive delay due to dwell times or charging times required by standard DC ignition systems that are used today.

The waveform 42 of FIG. 2 shows the electrical pulse from the engine control module 22. This pulse has a logic low 44 and a logic high 46. The pulse that goes from logic low 44 to logic high 46 will correspond to the rising edge 38 of the waveform 34. The time that the signal is at logic high 46 will correspond to the "on time" 36 of the waveform 34. The change from logic high 46 to logic low 44 will correspond with the falling edge 40 of the waveform 34. In this manner, the engine control module 22 will command the proper performance of the respective AC ignition coil(s) or transformer(s).

Within the system of the present invention, the twelve volts input is nominally the voltage of the power supply or battery. This can vary from six volts at cold cranking to 14.5 or 15.5 volts during normal operation. The typical circuit design can operate at six volts of battery input with slightly diminished output energy performance. The output voltage and energy of the high-voltage transformer is proportional to the input voltage. As such, it is necessary to provide enough voltage and energy input to start the vehicle during low-voltage conditions, such as cold starting. The system of the present invention and also utilize a 24 V power supply in the case of use in association with natural gas engines.

Figure 3:
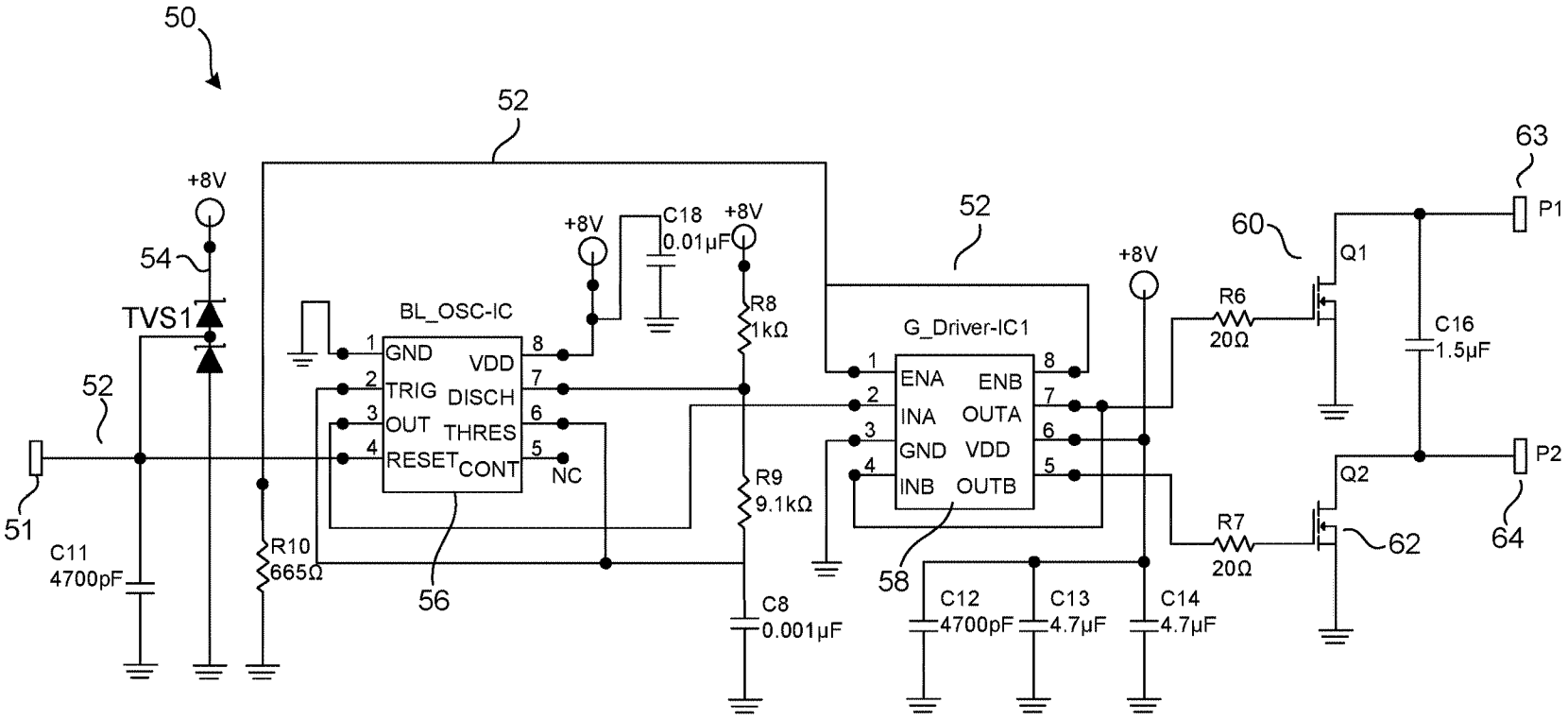
FIG. 3 is an electronic schematic of the driver circuit of the electronic spark timing control system of the present invention.

FIG. 3 shows electronic schematic for the driver circuit 50 associated with the electronic spark timing system of the present invention. Initially, the electronic spark timing pulse is received at the terminal 51. The spark timing pulse is transmitted along line 52. A transient voltage suppression diode device 54 is provided to suppress or filtered unwanted transients from the electronic spark timing input signal 51. Line 52 will extend to a baseline astable oscillator timing IC 56 to provide the enable signal which controls the output of the baseline timer IC 56 and also provides the enable signal to the inverting gate driver IC 58. The baseline oscillator timer IC 56 is configured to provide an eight volt output voltage of approximately 50% duty cycle at about 60 KHz frequency to the input of gate driver once both of the ICs 56 and 58 are enabled by the electronic spark timing input control signal 51. For example, if it is desired to set the logic high of waveform 42 (shown in FIG. 2) for two milliseconds, then the baseline oscillator timing IC 56 and the associated gate driver IC 58 will then be enabled for a period of 2 milliseconds. As such, waveform 42 will create the necessary timing for the electronic spark timing input pulse. The baseline oscillator timer IC 56 and gate driver IC 58 will ultimately create the waveform that is use to drive the $N_{channel}$ field effect transistors 60 and 62 which, in turn, provide the necessary switching signal for the firing of the spark plug(s) for the duration 36 of waveform 34 of FIG. 2.

The baseline oscillator timer capital IC 56 is connected to the inverting gate driver IC 58. Gate driver IC 58 is configured so as to alternately bias the $N_{channel}$ field effect transistors 60 and 62. When the $N_{channel}$ field effect transistors 60 and 62 are biased on, then voltage pulses can be transmitted to the primary coils 63 and 64. Ultimately, it is important that the gate driver IC 58 provide a 50% on/off duty cycle for each of the $N_{channel}$ field effect transistors 60 and 62. As such, the $N_{channel}$ field effect transistors 60 and 62 will never be on at the same time. The $N_{channel}$ field effect transistors 60 and 62 need to go on-and-off so as to avoid magnetic balancing issues on core saturation. This arrangement keeps the circuit simple, but effective. Importantly, as will be described hereinafter, the energy for the firing of the spark plug(s) is transmitted from the primary windings to the secondary windings by the driver circuit 50 commanding the power switching signals to the $N_{channel}$ field effect transistors 60 and 62.

The eight volt output voltage of the baseline oscillator timer IC 56 is important to the present invention and, in particular, important in automotive electronics. A greater amount of voltage will tend to deteriorate the quality of the $N_{channel}$ field effect transistors 60 and 62 although providing greater responsiveness. Within the automotive industry, is very important that reliability is the most important quality for the ignition system. A lesser amount of voltage than the eight volts can provide for less than the desired responsiveness of the $N_{channel}$ field effect transistors 60 and 62.

The $N_{channel}$ field effect transistor a negative gate-to-source voltage causes a depletion region to expand in width and encroach on the channel from the sides, narrowing the channel. If the active region expands to completely close the channel, the resistance of the channel from source to drain becomes large and the field effect transistor is effectively turned off like a switch. This is called pinch-off. The voltage at which this occurs is called the "pinch-off voltage". Conversely, a positive gate-to-source voltage increases the channel size and allows electrons to flow easily. In an $N_{channel}$ enhancement-mode device, a conductive channel does not exist naturally within the transistor and a positive gate-to-source voltage is necessary to create one. The positive voltage attracts free-floating electrons within the body towards the gate, forming a conductive channel. But first, enough electrons must be attracted near the gate to counter the dopant ions added to the body of the field effect transistor. This forms a region with no mobile characters and is called a "depletion region" and the voltage at which this occurs is referred to as the "threshold voltage" of the field effect transistor. Further gate-to-source voltage increase will attract even more electrons toward the gate which are able to create a conductive channel from the source to the drain. This process is called in version. If greater than eight volts is applied to the field effect transistor, then this can cause the oxide region within the field effect transistor to deplete more rapidly and ultimately cause a failure of the field effect transistor. Eight voltages has been found to be the optimum threshold voltage for the field effect transistors of the present invention.

In the present invention, it is important that $N_{channel}$ field effect transistors be used instead of $P_{channel}$ field effect transistors. In such $P_{channel}$ field effect transistor, a positive voltage from body creates a depletion layer by forcing the positively charged holes in the gate-insulator/semiconductor interface so as to leave exposed a carrier-free region of immobile, negatively charged acceptor ions. In the circumstances of the present invention, this arrangement would not have worked effectively, or if at all, for the ignition system.

Figure 4:
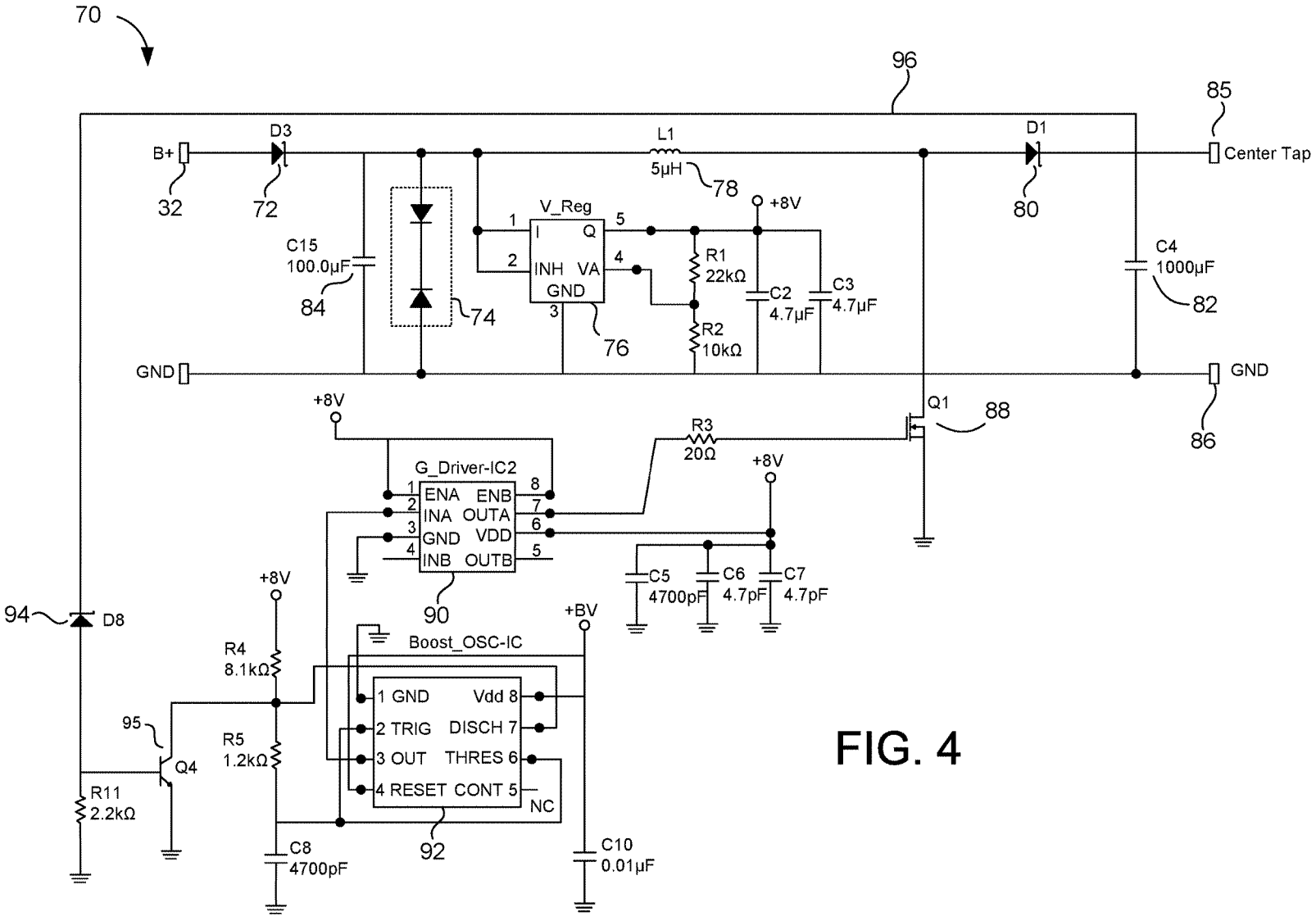
FIG. 4 is an electronic schematic of the boost voltage regulator circuit of the electronic spark timing control system of the present invention.

FIG. 4 shows the boost voltage regulator circuit 70 that optimally transfers the energy that is provided from the battery 30 to an input capacitor 84 and to the output capacitor 82. The driver circuit 50 then switches $N_{channel}$ field effect transistors 60 and 62 to convert the energy stored in capacitor 82 to energy provided to fire the respective spark plug(s). Additionally the battery 30 (as shown in FIG. 1) is connected to battery input line 32 of the boost voltage regulator circuit 70. A reverse battery protection diode 72 is provided on line 32 so as to prevent excessive return current due to misapplication of the battery polarity terminal input connection 32. Additionally, the line from battery terminal input connection 32 is connected to a transient voltage suppression device 74 which shunts the battery line from unwanted voltage spikes. In this arrangement, a clamping diode in both directions is illustrated in which the transient voltage suppression device is not in series with the line from the battery polarity terminal input connection 32.

A DC voltage regulator 76 is used to develop a precise fixed eight volt (Vdd) reference voltage used in the circuit architecture to provide a suitable reference voltage and power source for the digital electronic ICs and associated bias circuits. Upon application of the battery voltage to the circuit 70, the voltage regulator 76 provides bias to boost timer IC 92 and inverting gate driver IC 90 which, in turn, produce an approximately 20 to 50 KHz switching signal with an approximately 10% duty cycle. This is used to control the gate bias of the $N_{channel}$ field effect transistor 88. The boost timer IC 92 is an astable oscillator with a 90% on time. This is then inverted by the inverting gate driver IC 92 a 10% duty cycle. The "on time" duty cycle of they frequency set by the boost timer IC 92 is about 90% and is completely disabled when the voltage at node 85 reaches the target voltage of about 35 volts. This is controlled by the voltage feedback circuit line 96.

With the gate bias is applied to $N_{channel}$ field effect transistor 88 from the boost timer IC 92 and the gate driver buffer IC 90, the drain of $N_{channel}$ transistor 88 provides a ground path to charge or store energy into inductor 76 based on the 90% duty cycle provided by the control elements R4, R5, and C6 of boost timer IC 92. The stored energy in the inductor 78 is then transferred across diode 80 to charge the output capacitor 82 during switch-off of the $N_{channel}$ transistor 88. In this way, the timer IC 92, the inverting gate driver IC 90, the inductor 78, the diode 80, the switching $N_{channel}$ field effect transistor 88, the capacitor 84 (serving as the input capacitor), and the capacitor 82 (serving as the output capacitor) when taken together are the major design elements of the boost voltage regulator circuit 70. The output capacitor 82 is then charged to a desired target voltage of about 35 volts input.

The output capacitor 82 is then charged to a desired target voltage of about 35 volts. This target voltage is maintained by a sensing voltage developed across the Zener diode 94. When the Zener diode 94 reaches breakdown, the NPN transistor 95 is turned on. The collector of NPN transistor 95 provides a ground path for the boost timer for the discharge pin (7) of the boost timer IC 92. This, in turn, disables the boost isolator IC 92 from further commanding the charging of the output capacitor 82. As a result, regardless of the firing of the respective spark plugs 14 and 18 (see FIG. 1) by the electronic spark timing circuit 50 (see FIG. 3), the capacitor 92 for the boost voltage regulator circuit 70 will continue to be charged up during this process. As such, if the battery is low, the capacitor 82 will continue to be charged. The lack of charge on the battery 30 will not change (see FIG. 2) in any way. The majority of the energy for the firing of the spark plug(s) is the result of the pre-charging of the capacitor 82. Fundamentally, if the engine speed is high, then the battery 30 will be fully charged. This will meet the requirements for producing the waveform 34. If the battery is low and the vehicle is idling, the charge in the battery can be low. However, the energy required for the firing of the spark plug(s) as a virtue of the waveform 34 will be the same. Since the capacitor 82 is continually pre-charged to the desired target voltage by the boost voltage regulator circuit 70 of the present invention, the present invention avoids the need for any significant charging time for the AC ignition coil(s) or transformer(s). The energy is stored in capacitor 82 and is essentially continuously available by always recharging the capacitor 82 to the desired approximately 35 volts between and during the command electronic spark timing pulses, as described hereinbefore.

Ultimately, the output node 85 of the boost voltage regulator circuit 70 will be connected to the center tap of the primary coils 63 and 64. These are switch to ground by the $N_{channel}$ field effect transistors 60 and 62 and the base oscillator driver circuit 50, as illustrated in FIG. 3. The ground return 86 for the boost voltage regulator circuit 70 is connected to battery ground and is also provided to each of the AC ignition coil(s) or transformer(s).

In the present invention provides the necessary timing so as to fire the spark plug(s) for a duration equal to the engine control module command waveform 42 duration by virtue of the driver circuit 50 and the boost voltage regulator circuit 70. The present invention provides the necessary energy, in relation to the timing waveform 42, so as to present the AC high-voltage waveform 34 for the firing of the spark plug(s).

The present invention provides an AC ignition control system which allows for simple and direct control of the spark spark duration by use of the electronic spark timing signal directly and/or proportionately. The AC ignition control method provides a means for a series of short duration spark events which are timed from the rising edge to the falling edge of the electronic spark timing command pulse. The present invention further provides an AC control method which provides a means for a series of short or long duration spark events by direct control of the electronic spark timing pulse itself. The AC ignition system control method can be deployed via a serial data interface bus, a CAN transceiver, an application-specific integrated circuit (ASIC), or similar strategy so as to allow a similar precise digital control of the spark arc duration.

The foregoing disclosure and description of the invention is illustrative and explanatory thereof. Various changes in the details of the illustrated construction or the steps of the described method can be made within the scope of the appended claims without departing from the true spirit of the invention. The present invention should only be limited by the following claims and their legal equivalents.

We claim:

1. A spark AC ignition system comprising:

a spark plug;

an AC ignition coil connected to said spark plug so as to apply an AC voltage to said spark plug; and an engine control module connected to said AC ignition coil so as to provide an electronic spark timing pulse to said AC ignition coil, the AC voltage having a waveform with a rising edge and a falling edge, said engine control module transmitting a signal by an astable oscillator to said AC ignition coil so as to activate said spark plug during a period of time between the rising edge and the falling edge of the waveform.

2. The spark AC ignition system of claim 1, further comprising:

a battery connected to said engine control module, said battery producing at least six volts.

3. The spark AC ignition system of claim 2, further comprising:

a capacitor connected to an input of said AC ignition coil, said capacitor charging and discharging at least thirty volts.

4. A spark AC ignition system comprising:

a spark plug;

an AC ignition coil connected to said spark plug so as to apply an AC voltage to said spark plug;

an engine control module connected to said AC ignition coil so as to provide an electronic spark timing pulse to said AC ignition coil, the AC voltage having a waveform with a rising edge and a falling edge, said engine control module transmitting a signal to said AC ignition coil so as to activate said spark plug during a period of time between the rising edge and the falling edge of the waveform; and a first $N_{channel}$ field effect transistor and a second $N_{channel}$ field effect transistor connected to said AC ignition coil so as to transmit energy alternately to said spark plug.

5. The spark AC ignition system of claim 1, said waveform having a logic high of approximately 5 volts and a logic low of approximately 0 volts, the rising edge being from 0 volts to 5 volts, the falling edge being from 5 volts to 0 volts.

6. The spark AC ignition system of claim 1, the signal being between 25 microseconds and 5 milliseconds.

7. The spark AC ignition system of claim 1, said AC ignition coil activating said spark plug in correspondence with the signal from said engine control module.

8. The spark AC ignition system of claim 2, further comprising:

a boost voltage regulator circuit cooperative with said AC ignition coil so as to collect and store energy from said battery before and while said AC ignition coil activates said spark plug.

9. The spark AC ignition system of claim 1, further comprising:

an internal combustion engine, said spark plug cooperative with said internal combustion engine so as to fire a combustion mixture in a cylinder of said internal combustion engine when said spark plug is activated, said AC ignition coil mounted directly on said spark plug.

10. A method of firing a spark plug of an internal combustion engine, the method comprising:

supplying AC power from a battery through an engine control module and through an astable oscillator to the spark plug, the AC power having a waveform with a rising edge and a falling edge;

driving a gate driver and the astable oscillator so as to activate a field effect transistor for a period of time as to activate the spark plug during the rising edge of the waveform; and deactivating the spark plug during the falling edge of the waveform at an end of the period of time.

11. The method of claim 10, further comprising:

connecting an engine control module to an AC ignition coil; and connecting the AC ignition coil to the spark plug.

12. The method of claim 11, further comprising:

transmitting the AC power to the AC ignition coil, the AC ignition coil firing between the rising edge and the falling edge of the waveform.

13. The method of claim 11, a firing duration of the AC ignition coil mirroring a control waveform duration from the engine control module.

14. The method of claim 11, further comprising:

connecting a battery to the engine control module, the battery having at least six volts.

15. The method of claim 14, further comprising:

converting DC voltage from the battery into a high-voltage AC waveform.

16. The method of claim 14, further comprising:

storing energy from the battery during the steps of deactivating and activating and while being activated.

17. The method of claim 10, the waveform being a square wave between 0 volts and 15 volts.

18. The method of claim 10, the step of deactivating being between 25 microseconds and 10 milliseconds following the step of driving.

19. The method of claim 10, the step of driving comprising:

continuously firing the spark plug during a period between the rising edge and the falling edge of the waveform.

* * * * *